US010357101B1

(12) United States Patent
Maman

(10) Patent No.: US 10,357,101 B1
(45) Date of Patent: Jul. 23, 2019

(54) HAIR BRUSH

(71) Applicant: Priel Maman, Ft. Lauderdale, FL (US)

(72) Inventor: Priel Maman, Ft. Lauderdale, FL (US)

(73) Assignee: Sobe Brush Co., LLC, Edgewood, NY (US)

( * ) Notice: Subject to any disclaimer, the term of this patent is extended or adjusted under 35 U.S.C. 154(b) by 0 days.

(21) Appl. No.: 16/011,879

(22) Filed: Jun. 19, 2018

Related U.S. Application Data

(63) Continuation-in-part of application No. 29/644,042, filed on Apr. 13, 2018.

(51) Int. Cl.
*A45D 24/16* (2006.01)
*A46B 5/00* (2006.01)
*A46B 9/02* (2006.01)

(52) U.S. Cl.
CPC ..... *A46B 5/002* (2013.01); *A46B 9/023* (2013.01); *A46B 2200/104* (2013.01)

(58) Field of Classification Search
CPC ..... A45D 20/52; A45D 20/525; A46B 3/18; A46B 9/00; A46B 9/02; A46B 9/023; A46B 9/026; A46B 9/028; A46B 9/08; A46B 9/10; A46B 9/12
See application file for complete search history.

(56) References Cited

U.S. PATENT DOCUMENTS

| | | | | |
|---|---|---|---|---|
| 4,464,562 | A | 8/1984 | Takimae | |
| 5,765,575 | A | 6/1998 | Denebeim | |
| 7,121,285 | B2 | 10/2006 | Kraus | |
| D557,018 | S * | 12/2007 | Park | D4/128 |
| D672,498 | S | 12/2012 | Kim | |
| D767,203 | S | 9/2016 | Gonzalez et al. | |
| 2003/0110585 | A1 * | 6/2003 | Rechelbacher | A46B 5/00 15/143.1 |
| 2010/0251499 | A1 | 10/2010 | Bigio | |
| 2011/0192417 | A1 | 8/2011 | Catini | |
| 2013/0263883 | A1 | 10/2013 | Story | |
| 2014/0059792 | A1 * | 3/2014 | Naccour | A46B 9/023 15/160 |

FOREIGN PATENT DOCUMENTS

| | | | |
|---|---|---|---|
| EP | 1491109 | A1 | 12/2004 |
| FR | 2588459 | A1 | 10/1985 |

* cited by examiner

*Primary Examiner* — Rachel R Steitz
(74) *Attorney, Agent, or Firm* — Barnes & Thornburg LLP

(57) ABSTRACT

A hair brush for use with a person's head of hair is described in this disclosure. The hair brush illustratively includes a handle and a brush head with bristles that extend out from a hair-shaping guide.

13 Claims, 3 Drawing Sheets

HAIR BRUSH

PRIORITY CLAIM

This application is a continuation-in-part of U.S. application Ser. No. 29/644,042, filed Apr. 13, 2018, which is expressly incorporated by reference herein.

BACKGROUND

Hair brushes are pulled through a person's head of hair to untangle the hair. These devices include a handle formed to include a grip and a brush head with a plurality of bristles to engage the hairs on a person's head. Sometimes, hair brushes can be used to shape the person's head of hair for stylistic reasons. While there are a number of different hair brushes available, there is still a need for brushes optimized for shaping hair into specific hair styles.

SUMMARY

A hair brush for use with a person's head of hair is described in this disclosure. The hair brush includes a handle and a brush head for shaping the person's hair.

In illustrative embodiments, the hair brush includes a brush head that provides a means for engaging the person's head of hair and shaping a plurality of hairs included in the person's head of hair. The brush head includes a hair-shaping guide and a plurality of bristles extending outwardly from the hair-shaping guide. The hair-shaping guide is illustratively configured to engage the person's head of hair. The hair-shaping guide is shaped to include a plurality of interconnected bulbs and necks that shape the plurality of hairs when the hairs are engaged with the hair-shaping guide upon application of hot air from a blow dryer. In one example, the plurality of hairs may form an irregular curl shape, sometimes called a beach wave curl, when styled with brushes as disclosed in this paper.

Additional features of the present disclosure will become apparent to those skilled in the art upon consideration of illustrative embodiments exemplifying the best mode of carrying out the disclosure as presently perceived.

BRIEF DESCRIPTIONS OF THE DRAWINGS

The detailed description particularly refers to the accompanying figures in which.

Figure 1:
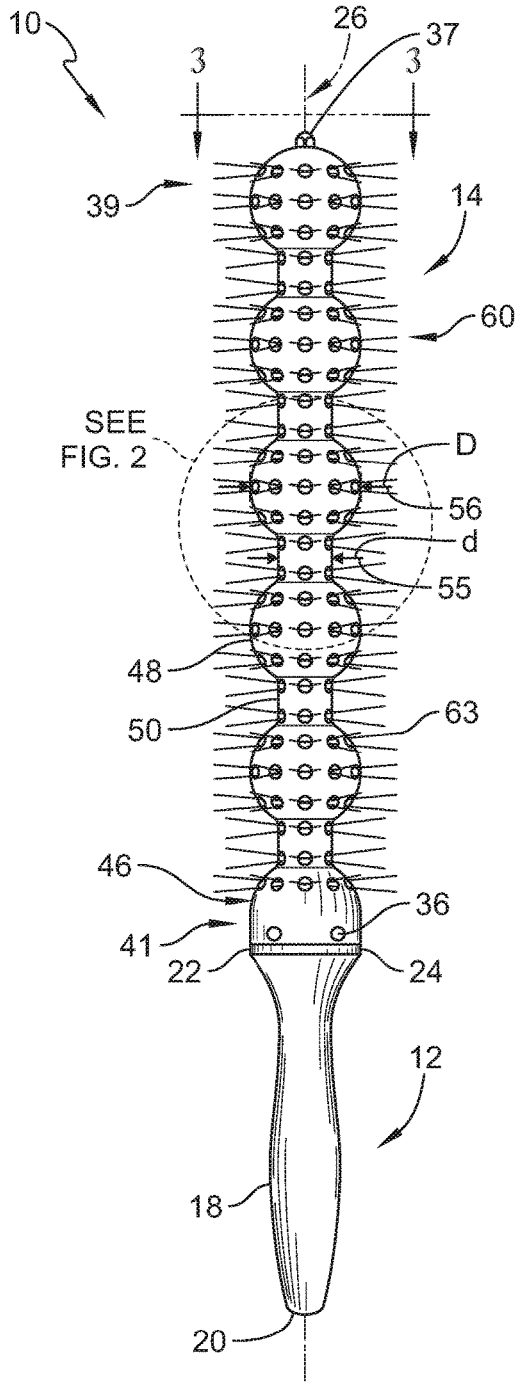
FIG. 1 is a side perspective view of a hair brush showing a handle and a brush head, the handle is formed to include a grip and the brush head includes a plurality of bristles extending from a hair-shaping guide.
Figure 5:
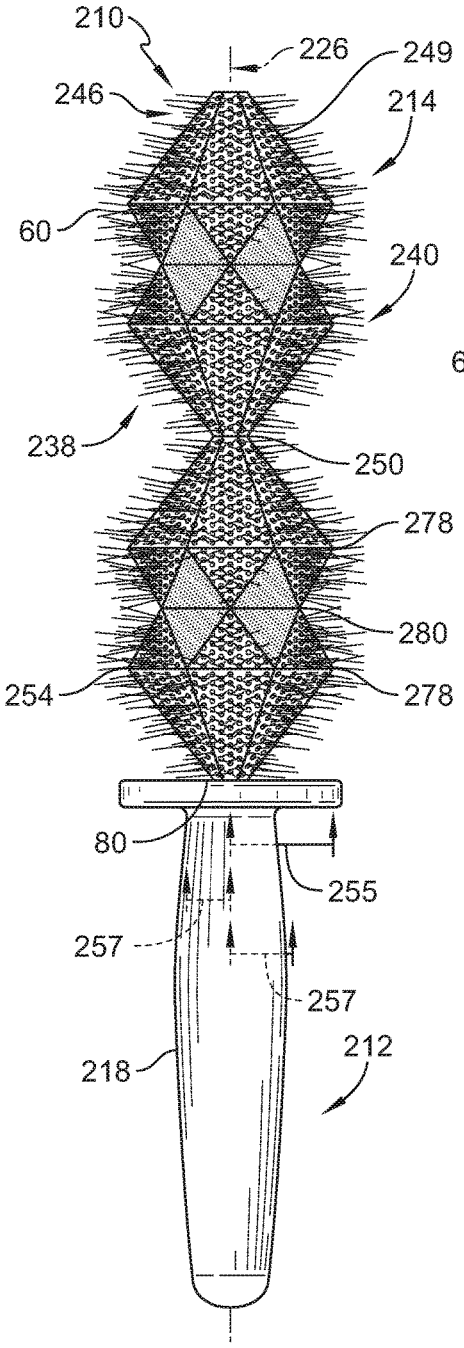
Figure 6:
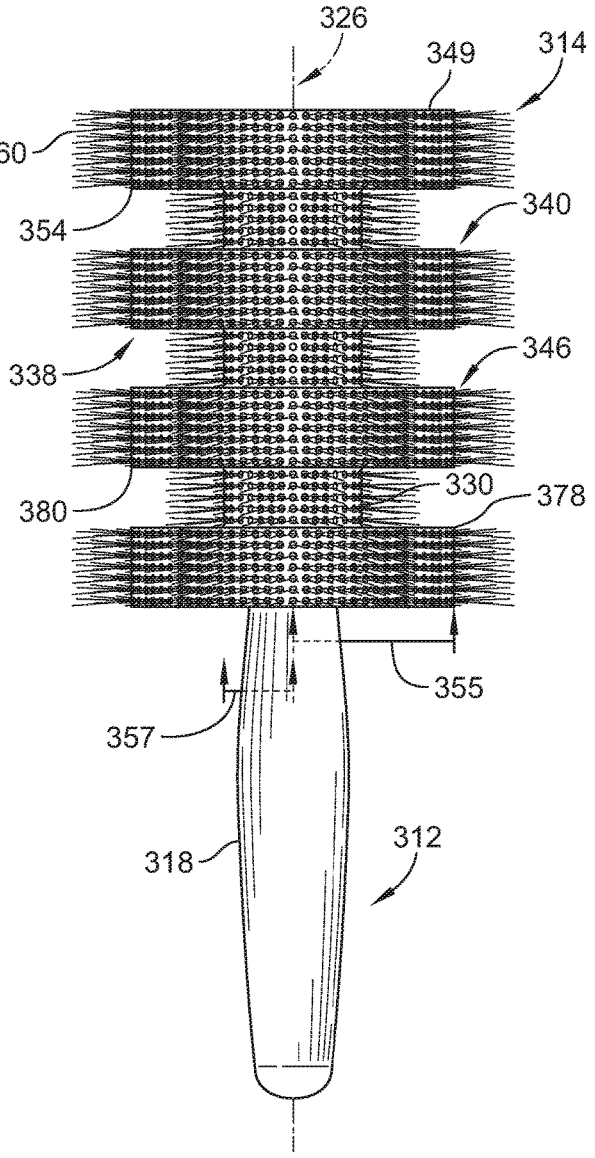

FIG. 5 is an alternative embodiment of the brush head shown in FIG. 1, the brush head includes a plurality of interconnected bulbs and necks shaped such that the outermost surfaces of the bulbs and necks are substantially planar, the bulbs and necks cooperate to form a diamond shape; and FIG. 6 is an alternative embodiment of the brush head shown in FIG. 1, the brush head includes a plurality of interconnected bulbs and necks shaped such that the outermost surfaces of the bulbs and necks are substantially planar, each of the bulbs forms a rectangular shape.

DETAILED DESCRIPTION

A hair brush 10, 210, 310 according to the present disclosure may be used with a blow dryer or other heating tool to style a person's hair such that the hair is shaped as a desired wave/curl (i.e.: beach wave curls, irregular curls, etc.). The hair brushes 10, 210, 310 each include a handle for a person to grip in his/her hand and a brush head to brush and shape the hair of the person. The hair is shaped using a heating tool in combination with the two components of the brush head 14, 214, 314: the hair-shaping guide 38, 238, 338 and the bristles. The hair-shaping guide 38, 238, 338 may be shaped in a variety of ways such that a diverse range of waves/curls may be achieved using the hair brush 10, 210, 310.

The shape of the hair-shaping guides 38, 238, 338 create a desired wave/curl in the person's hair when heat is applied. In the illustrative embodiments, the hair-shaping guide 38, 238, 338 may be provided by a hollow shell. The bristles 60, 260, 360 are located inside of the hollow shell and extend through holes formed in the hollow shell. This allows the bristles 60, 260, 360 to grip the hair so that the hair comes into contact with the hollow shell and remains in contact with the hollow shell throughout heating.

To shape the hair, a person wraps a section of hair around the brush head 14, 214, 314 so that the bristles 60, 260, 360 grip the hair and the hair is positioned on the hollow shell. The user then applies hot air from a blow dryer onto the hair wrapped around the brush head 14, 214, 314. After a desired length of time, the user removes the hot air from the hair wrapped around the brush head 14, 214, 314 and unwraps the hair from the brush head 14, 214, 314. The hot air from the blow dryer and the unique shape of the hair-shaping guide style the hair in a desired wave/curl so that the wave/curl is maintained even after unwrapping the hair from the brush head.

The hair-shaping guide 38, 238, 338 provided by the hollow shell creates the wave/curl based on the shapes used to form the hollow shell. To explain, the hollow shell may include circular or partially-hemispherical bulbs 48 connected by necks 50 that are smaller than the bulbs 48. The difference in the sizes of the bulbs 48 and necks 50 shape the hair so that the sections of the hair that are in contact with the bulb 48 when heated create a larger curl/wave than the sections of hair in contact with the necks 50 when heated. This creates the desired curl/wave in the treated section of hair. The bulbs 248, 348 and necks 250, 350 of the hollow shell may also be formed as diamonds, rectangles, and other known shapes and combinations thereof as suggested in FIGS. 5 and 6.

Turing to FIG. 1 of the drawings, a hair brush 10 according to the present disclosure is adapted to shape a person's head of hair when hot air is applied on the hair brush 10 and the person's head of hair wrapped around the hair brush 10. Illustratively, the hot air is produced by a heat source (not shown) (i.e.: blow dryer). The hair brush 10 includes a handle 12 and a brush head 14, as shown in FIG. 1. The handle 12 may be made of a variety of materials configured to withstand residual heat applied on the handle 12 upon heating the brush head 14 via the heat source. The brush head 14 is coupled to the handle 12 and configured to removeably couple to a plurality of hairs (not shown) included in a person's head of hair so to shape the plurality of hairs using the heating tool.

Figure 4:
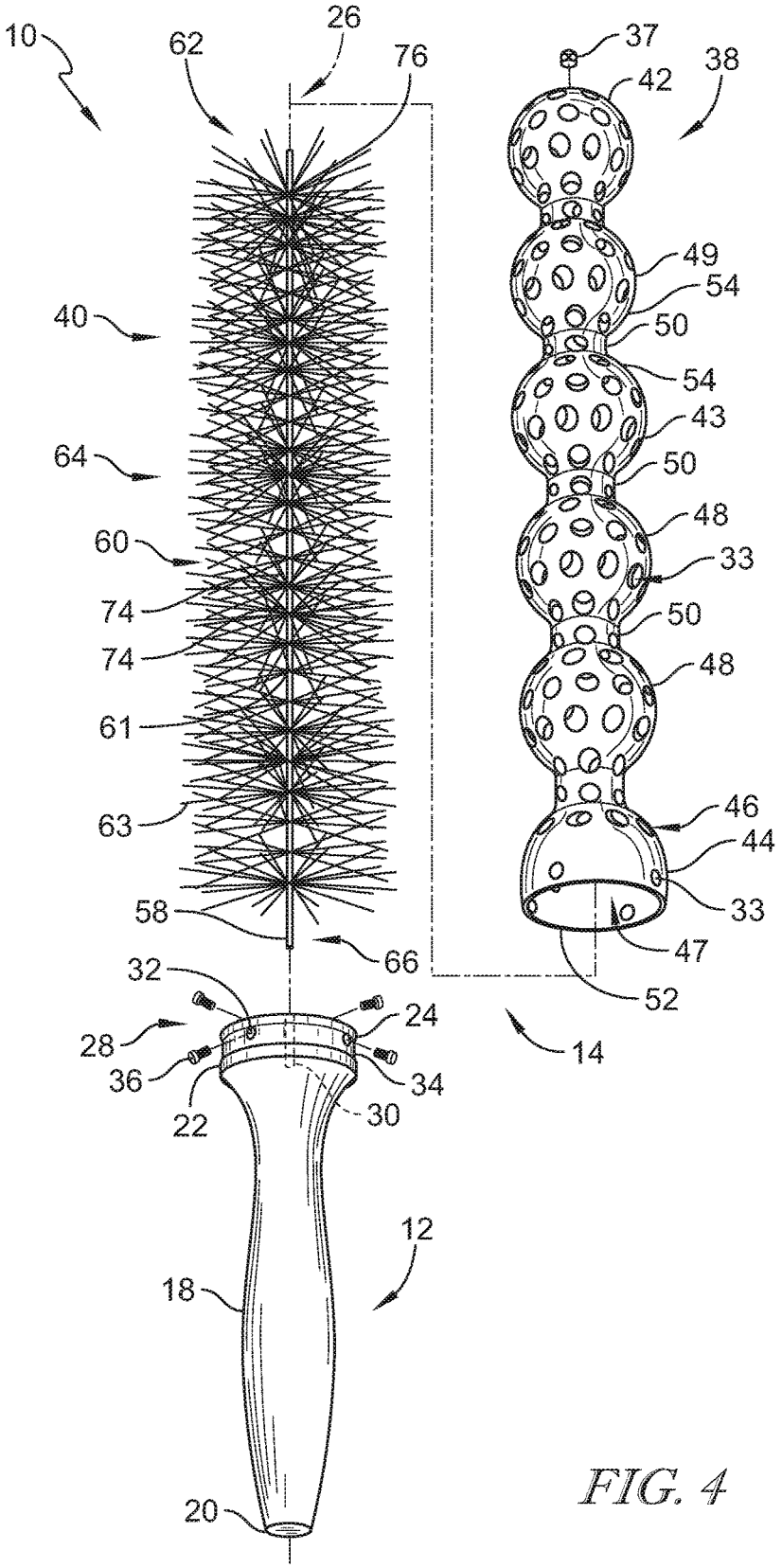
FIG. 4 is an exploded perspective view of the hair brush as shown in FIG. 1 showing the handle, the bristles, and the hair-shaping guide spaced apart from each other and suggesting that the hair-shaping guide is formed from a hollow shell that overlays the bristles such that the bristles extend outwardly from the hair-shaping guide in multiple opposing directions.

The handle 12 is illustratively shaped to be held in a hand of a user as shown in FIGS. 1 and 4. The handle 12 is a monolithic, one-piece component formed separate from the brush head 14 and formed to include a grip 18 at a distal end 20 and a mount 22 at a proximal end 24. The mount 22 interconnects the grip 18 and the brush head 14 as best shown/suggested in FIGS. 1 and 4. The grip 18 defines a primary/central axis 26. The mount 22 is shaped to fit within the brush head 14 such that a substantial portion of the mount 22 is positioned inside of the brush head 14 prior to coupling the handle 12 to the brush head 14. Such coupling may be achieved in a variety of manners. Illustratively, the mount 22 is formed to include a coupling means 28 configured to couple the brush head 14 and the handle 12 at the mount 22. The coupling means 28 includes a rod receiver 30 and a plurality of fastener holes 32 formed in the mount 22 of the handle 12. The rod receiver 30 is illustratively formed in a substantially vertical manner along the primary axis 26 and configured to receive a portion of the brush head 14. The fastener holes 32 are formed in an outer wall 34 of the mount 22 and configured to receive a plurality of mount fasteners 36. Illustratively, the fasteners 36 are threaded screws configured to be received by the plurality of fastener holes 32 after the brush head 14 has been placed on the mount 22 as shown in FIG. 1.

The brush head 14 is illustratively formed independent of the handle 12 such that prior to coupling, the brush head 14 and the handle 12 are distinct from one another. The brush head 14 includes a hair-shaping guide 38 and a hair-engagement portion 40 as best shown in FIG. 4. Illustratively, the hair-shaping guide 38 is formed from a continuous hollow shell 46 and shaped such that the hair-engagement portion 40 fits substantially within the hair-shaping guide 38 as shown in FIG. 1. The hollow shell 46 forms an interior space 47 defined by an outermost surface 49 of the hair-shaping guide 38. Therefore, the hair-engagement portion 40 is located inside of the hair-shaping guide 38 within the interior space 47. Further, the hollow shell 46 has a substantially constant thickness between the interior space 47 and the outermost surface 49 of the hair-shaping guide 38.

The hair-engagement portion 40 of the brush head 14 is configured to removeably engage the plurality of hairs such that the hairs are guided into engagement with the hair-shaping guide 38. Illustratively, the two separate components of the brush head 14 are maintained in such a position via a retainer 37 located at an upper end 39 of the hair brush 10 such that the hair-engagement portion 40 may not be removed from within the hair-shaping guide 38 without first removing the retainer 37 and the hair-shaping guide 38 itself. Further, the hair-engagement portion 40 is coupled to the mount 22 of the handle 12 independent of the hair-shaping guide 38 at a lower end 41 of the hair brush 10 and the hair-shaping guide 38 is coupled to the mount 22 of the handle 12 independent of the hair-engagement portion 40 at a lower end 41 of the hair brush 10.

The hair-shaping guide 38 is designed to engage the plurality of hairs when the hair-engagement portion 40 is removeably coupled to the plurality of hairs. The hair-shaping guide 38 is formed to include a mount portion 44 coupled to the handle 12 along the primary axis 26, a retainer portion 42 spaced apart from the mount portion 44, and a central portion 43 extending between the mount portion 44 and the retainer portion 42 along the primary axis 26. The hair-shaping guide 38 further includes a plurality of bulbs 48, a plurality of necks 50, and a mount receiver 52 as shown in FIG. 4. The bulbs 48 are spaced apart from one another along the central axis 26 extending along the central portion 43 from the retainer portion 42 to the mount portion 44 and are interconnected by the necks 50. Illustratively, the necks 50 and the bulbs 48 are positioned such that the necks 50 extend between a pair of bulbs 54 spaced apart from one another along the central axis 26 such that each bulb 54 is coupled to at least one neck 50. The mount receiver 52 is coupled to a neck 50 and located at the mount portion 44 of the hair-shaping guide 38 and configured to couple the hair-shaping guide 38 to the mount 22 of the handle 12 via a plurality of fastener apertures 35 formed in the hollow shell 46 of the hair-shaping guide 38.

The plurality of bulbs 48 are designed to engage and shape the plurality of hairs into a desired shape with the use of directed, heated air. To withstand such heat, the bulbs 48 are formed from metallic or ceramic-containing materials suitable for heating by the heating source. The resulting shape of the hairs is dependent upon the shape and size of the bulbs 48 and the necks 50. Therefore, a variety of shapes and degrees of curliness may be produced using the hair brush 10 (i.e.: curls of varying tightness, waves, kinks, coils, etc.).

Figure 2:
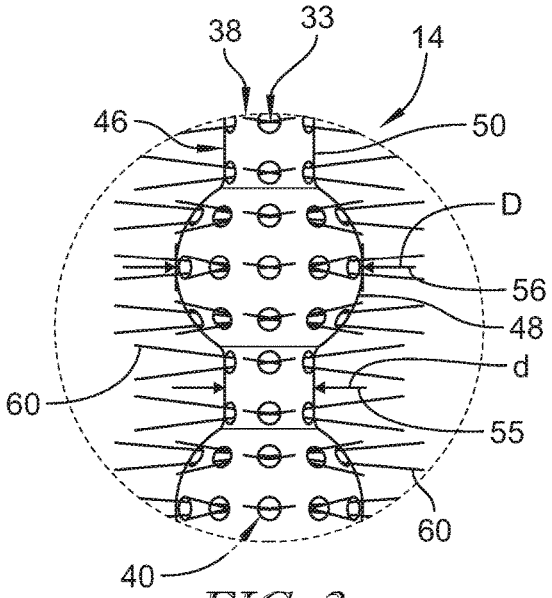
FIG. 2 is an enlarged perspective view of the brush head as shown in FIG. 1 showing that the hair-shaping guide includes a plurality of interconnected bulbs and necks, the hair-shaping guide is formed to include a plurality of bristle apertures.

To explain, each bulb 48 and each neck 50 include a diameter 56, 55 as shown in FIG. 2. Illustratively, the bulb diameter 56 is larger than the neck diameter 55 such that a desired arc length of a curl/wave in the plurality of hairs may be achieved. Further, in increasing the size of the bulb diameter 56 and/or decreasing the size of the neck diameter 55, the arc length of the curl/wave increases thereby resulting in a larger curl/wave. In contrast, increasing the diameter of 55 of the neck 50 and/or decreasing the diameter 56 of the bulb 48 results in a decrease of the arc length of the curl/wave thereby resulting in a smaller wave/curl. Further, the bulbs 48 include a plurality of bristle apertures 33 formed in the outermost surface 49 of the hollow shell 46 forming the bulbs 48. The bristle apertures 33 are spaced apart from one another and extend along the primary axis 26 from the retainer portion 42 to the mount portion 44 of the hair-shaping guide 38. Illustratively, the bulbs 48 are substantially circular. Yet, as will be discussed, the bulbs 48 and the necks 50 may be formed in a variety of shapes as shown in FIGS. 5 and 6.

The plurality of necks 50 are designed to interconnect the bulbs 48 and cooperate to engage the plurality of hairs and shape the hairs as desired. Similar to the bulbs 48, the necks 50 are formed from metallic or ceramic-containing materials suitable for heating by the heating source and are also formed to include a plurality of bristle apertures 33 in the outermost surface 49 of the hollow shell 46 forming the necks 50. The bristle apertures 33 are spaced apart from one another extending along the primary axis 26 from the retainer portion 42 to the mount portion 44 of the hair-shaping guide 38. The necks 50 cooperate with the bulbs 48 to increase the surface area of the hair-shaping guide 38 such that the plurality of hairs are engaged with both the bulbs 48 and the necks 50 simultaneously. Illustratively, the diameter 55 of each neck 50 is smaller than the diameter 56 of each bulb 48.

The mount receiver 52 is designed to couple the hair-shaping guide 38 to the handle 12 and is located at the mount portion 44 of the hair-shaping guide 38. The mount receiver 52 is formed to include a plurality of fastener apertures 35 in the outermost surface 49 of the hollow shell 46 which defines the mount receiver 52. The fastener apertures 35 are shaped to align with the fastener holes 32 formed in the mount 22 of the handle 12 so to couple the handle 12 to the hair-shaping guide 38 such that the brush head 14 extends between the distal end 20 of the handle 12 and the retainer portion 42 of the hair-shaping guide 38.

The hair-engagement portion 40 is configured to removeably couple to the plurality of hairs and guide the hairs into engagement with the hair-shaping guide 38 as shown in FIG. 1. The hair-engagement portion 40 includes a bristle-support rod 58 extending along the central axis 26 and a plurality of bristles 60 coupled to the bristle-support rod at a first end 61 of each of the bristles 60 such that the free end 63 of each bristle 60 extends away from the bristle-support rod 58. The hair-engagement portion 40 is at least partially housed within the hair-shaping guide 38 such that the bristle-support rod 58 is positioned in the interior space 47. Illustratively, the first end 61 of each bristle 60 is also positioned in the interior space 47 such that the free end 63 of each bristle 60 extends through the bristle apertures 33 formed in the hair-shaping guide.

The bristle-support rod 58 is shaped to fit within the hair-shaping guide 38 and extends vertically along the central axis 26 away from the handle 12. The bristle support rod 58 includes an end portion 62, a middle portion 64, and an attachment portion 66. The end portion 62 is spaced apart from the attachment portion 66 and located within the interior space 47 of the retainer portion 42 of the hair-shaping guide 38. The end portion 62 is coupled to the retainer portion 42 of the hair-shaping guide 38 via a retainer 37. Illustratively, the retainer 37 is either threaded or glued to the applicable portions 62, 42, although other methods known by those in the art also suffice. The middle portion 64 extends between the end potion 62 and the attachment portion 66. The middle portion 64 is sized to extend the length of the hair-shaping guide 38 and to fit within the hair-shaping guide 38. The attachment portion 66 extends from the middle portion 64 along the central axis 26 towards the handle 12. Illustratively, the attachment portion 66 is coupled to the mount 22 of the handle 12 in the rod receiver 30 formed in the mount 22. The bristle-support rod 58 is coupled to the plurality of bristles 60 at the first ends 61 such that the bristles 60 extend at least the length of the end portion 62 and the middle portion 64. The bristles 60 may further extend along the attachment portion 66.

Figure 3:
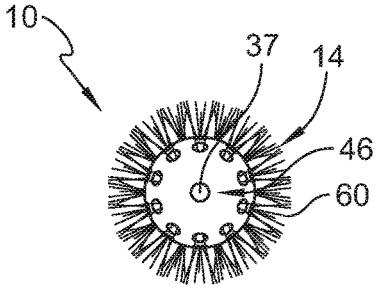
FIG. 3 is a sectional view of the brush head of FIG. 1 taken along line 3-3 shown in FIG. 1.

The plurality of bristles 60 are, illustratively, planar extensions that extend outwardly from the first ends 61 coupled to the bristle-support rod 58 and extend along the length of the middle portion 64 and end portion 62 of the rod 58. The bristles 60 are made of materials configured to withstand the heated air applied on the hair brush 10 by the heating tool. Illustratively, the bristles 60 are uniformly sized to extend through the bristle apertures 33 formed in the hair-shaping guide 38 such that at least half of the length of the bristle 60 extends away from the bristle aperture 33. Further, the bristles 60 may vary in length such that not all of the bristles 60 extend the same distance from the bristle aperture 33. Further, the bristles 60 extend outwardly in multiple opposing directions of the rod 58, as shown in FIG. 3. Illustratively, some of the bristles 60 are coupled to the end portion 62 and extend upwardly away from the handle 12. As such, the bristles 60 are coupled to the rod 58 at a variety of angles 74 in multiple opposing directions. Illustratively, the bristles 60 are arranged in clusters 76 along the rod 58 with each cluster 76 including at least two bristles 60. Single bristles 60 may also be coupled to the rod 58. The bristles 60 of each cluster 76, illustratively, extend from the rod 58 at a variety of angles 74 ranging between 30° and 160° relative to the central axis as shown in FIG. 4. Each bristle 60 of the cluster 76 extends through a shared bristle aperture 33 such that more than more bristle, illustratively, extends through each aperture 33 outwardly in multiple opposing directions.

In the illustrative embodiment, the shape of the hair-shaping guide 38 allows for the hairs to be shaped/styled in a variety of ways. Accordingly, the bristles 60 are configured to engage the hairs such that the hairs comes into contact with the hair-shaping guide 38. Illustratively, the hairs are wrapped around the brush head 14 such that the hairs covers a portion of the brush head 14 and are positioned to lie substantially flat along the outermost surface 49 of the hair-shaping guide 38 before heat is applied.

According to one method of using the disclosed hair brush 10, a person can shape/style the plurality of hairs to form a desired shape (i.e.: a wave). At a first step of shaping the hairs, the user holds the hair brush 10 at the handle 12 of the hair brush 10. The user then wraps a plurality of hairs around the brush head 14 by engaging the bristles 60 with the hairs, at the wrapping step. At step three, the user applies heat by directing hot air from a heat source (i.e.: blow dryer) on the plurality of hairs and the brush head 14 so to form the hairs in the desired shape. The user then unwraps the plurality of hairs from around the brush head 14 after heat has been applied, at the unwrapping step. The method may further include repeating the first four steps upon a different plurality of hairs until a desired portion of the person's head of hair is shaped to include a desired arc length of the curls/waves, at a fifth step. Additionally, the wrapping step may include simultaneously rotating the hair brush 10 in an engaging direction around the primary axis of rotation 26 towards the person's head of hair to secure the plurality of hairs to the bristles 60 extending from the hair-shaping guide 38 included in the brush head 14. The wrapping step may further include holding the hair brush 10 such that tension is placed on the plurality of hairs before heat is applied so that at least a portion of the plurality of hairs are in contact with the hair-shaping guide 38 before heat is applied. The unwrapping step may also include removing the plurality of hairs from the brush head 14 by rotating the hair brush 10 in a direction around the primary axis 26 opposite that of the engaging direction thereby removing the tension applied to the plurality of hairs after heat has been applied.

A second hair brush 210 according to the present disclosure is adapted to shape a person's head of hair when hot air is applied on the hair brush 210 and the person's head of hair from a heat source (not shown). The second hair brush 210 is shown in FIG. 5 of the present disclosure. The second hair brush 210 is substantially similar to the first hair brush 10 shown in FIGS. 1-4 and described above. Accordingly, the description of the hair brush 10 is hereby incorporated by reference to apply to the hair brush 210 except as it departs from the further description and drawings of the hair brush 210.

The second hair brush 210 includes a handle 212 formed to include a grip 218 and a brush head 214 including a hair-shaping guide 238 and a hair-engagement portion 240, as shown in FIG. 5. The hair brush 210 differs from the hair brush 10 in each of the bulbs 254 included in the hair-shaping guide 238 have a three-dimensional polygonal shape as shown in FIG. 5. Each of the bulbs 254 illustratively includes a length 255 from the central axis 226 to an outermost point 278 of the bulb 254 sized to be larger than the length 257 from the central axis 226 to an outermost point 280 of the each of the necks 250. Illustratively, the outermost surfaces 249 of the hair-shaping guide 238, formed by a hollow shell 246, are planar and form a plurality of facades configured to engage the plurality of hairs. Illustratively, the bulbs 254 and necks 250 are substantially diamond shaped.

A third hair brush 310 according to the present disclosure is adapted to shape a person's head of hair when hot air is applied on the hair brush 310 and the person's head of hair from a heat source (not shown). The third hair brush 310 according is shown in FIG. 6 of the present disclosure. The third hair brush 310 is substantially similar to the first hair brush 10 shown in FIGS. 1-4 and described above. Accordingly, the description of the hair brush 10 is hereby incorporated by reference to apply to the hair brush 310 except as it departs from the further description and drawings of the hair brush 310.

The third hair brush 310 differs from the hair brush 10 in that each of the bulbs 354 included in the hair-shaping guide 338, illustratively, include a length 355 from the central axis 326 to an outermost point 378 of the bulb 354 sized to be larger than the length 357 from the central axis 326 to an outermost point 380 of the each of the necks 350 as shown in FIG. 6. Illustratively, the outermost surfaces 349 of the hair-shaping guide 338, formed by a hollow shell 346, are planar and form a plurality of facades configured to engage the plurality of hairs. Illustratively, the bulbs 354 are substantially rectangular shaped.

It is contemplated herein that the hair-engagement portion and the hair-shaping guide described herein may be modified into a singular component. The spaced apart hair-engagement portion and hair-shaping guide described may, in some embodiments, be replaced by a single brush head wherein both components are integrated into the single brush head.

The following numbered clauses include embodiments that are contemplated and non-limiting:

Clause 1. A hair brush for use with a person's head of hair, the hair brush comprising a handle including a grip that defines a primary axis and is shaped to be held in a hand of a user, and a brush head coupled to the handle, the brush head including a hair-shaping guide and a plurality of bristles that extend outwardly from the hair-shaping guide in multiple opposing directions when the hair brush is viewed from above along the primary axis, wherein the hair-shaping guide is shaped to form a plurality of bulbs that each define a bulb diameter around the primary axis and a plurality of necks that each define a neck diameter around the primary axis that is smaller than the bulb diameter, each of the plurality of necks arranged between a pair of bulbs including the plurality of bulbs along the primary axis to space each bulb in the pair of bulbs from one another, the hair-shaping guide is configured to engage a plurality of hairs wrapped around the head of the hair brush to shape the plurality of hairs upon application of hot air from a blow dryer so that a desired shape is maintained when the plurality of hairs are unwrapped from the brush head of the hair brush.

Clause 2. The hair brush of any other suitable clause or combination of clauses, wherein the hair-shaping guide is provided by a hollow shell that forms an interior space and the hollow shell is formed to include a plurality of apertures, and wherein the plurality of bristles extend through the plurality of bristle apertures from the interior space.

Clause 3. The hair brush of any other suitable clause or combination of clauses, wherein the hollow shell has a substantially constant thickness between the interior space and an outermost surface of the hair-shaping guide.

Clause 4. The hair brush of any other suitable clause or combination of clauses, wherein the hair-shaping guide comprises metallic of ceramic-containing materials suitable for heating by hot air from a blow dryer.

Clause 5. The hair brush of any other suitable clause or combination of clauses, wherein the hair-shaping guide includes a mount portion coupled to the handle along the primary axis, a retainer end portion spaced apart from the mount portion, and a central portion located between the mount portion and the retainer end portion.

Clause 6. The hair brush of any other suitable clause or combination of clauses, wherein the plurality of bristles extend outwardly from the hair-shaping guide along the primary axis at a plurality of angles such that the plurality of bristles extend between the mount portion and the retainer end portion.

Clause 7. The hair brush of any other suitable clause or combination of clauses, the brush head further including a bristle support rod configured to couple the hair-shaping guide to the handle.

Clause 8. The hair brush of any other suitable clause or combination of clauses, wherein the handle is further includes a mount adjacent to the grip along the primary axis and the mount portion of the hair-shaping guide configured to receive at least a portion of the mount included in the handle.

Clause 9. The hair brush of any other suitable clause or combination of clauses, the brush head includes a hair engagement portion arranged inside the hair-shaping guide, made up of the plurality of bristles and a bristle support rod for shaping the plurality of hairs upon application of hot air from the blow dryer so that a desired shape is maintained when the plurality of hairs are unwrapped from the head of the hair brush.

Clause 10. A hair brush comprising a handle including a grip that is shaped to be held in a hand of a user, and a brush head coupled to the handle the brush head including a hair-shaping guide and a plurality of bristles that extend outwardly from the hair-shaping guide in multiple directions when the hair brush is viewed from above, wherein the hair-shaping guide is shaped to form a plurality of bulbs each defined by an outermost bulb surface spaced apart from a central axis of the brush head thereby defining a first distance perpendicular to the central axis and a plurality of necks each defined by an outermost neck surface spaced apart from the central axis thereby defining a second distance perpendicular to the central axis and smaller than the first distance.

Clause 11. The hair brush of any other suitable clause or combination of clauses, wherein the outermost bulb surface and the outermost neck surface cooperate to form a hollow shell that forms an interior space and the hollow shell is formed to include a plurality of bristle apertures, and wherein the plurality of bristles extend through the plurality of bristle apertures from the interior space.

Clause 12. The hair brush of any other suitable clause or combination of clauses, wherein the plurality of bristles are sized to be larger than the first distance and extend through the bristle apertures, and wherein the plurality of bristles are configured to engage a plurality of hairs.

Clause 13. The hair brush of any other suitable clause or combination of clauses, wherein the plurality of bristles extend from the hair-shaping guide at a plurality of angles relative to the central axis.

Clause 14. The hair brush of any other suitable clause or combination of clauses, wherein at least a portion of the plurality of bristles extend from the hair-shaping guide at an angle greater than 90° relative to the central axis.

Clause 15. The hair brush of any other suitable clause or combination of clauses, wherein at least a portion of the plurality of bristles extend from the hair-shaping guide at an angle less than 90° relative to the central axis.

Clause 16. A method for using a hair brush with a person's head of hair to form a wave shape in a plurality of hairs of a user, the method comprising the steps of holding the hair brush at a handle of the hair brush;

wrapping a plurality of hairs around a brush head of the hair brush;

applying heat by directing hot air from a blow dryer on the plurality of hair and the brush head; and unwrapping the plurality of the hairs from around the brush head after heat has been applied.

Clause 17. The method of any other suitable clause or combination of clauses, the method further including the step of repeating the method of claim 16 upon a different plurality of hairs until a desired portion of the person's head of hair is shaped as a wave.

Clause 18. The method of any other suitable clause or combination of clauses, wherein the wrapping step includes simultaneously rotating the hair brush in an engaging direction around a primary axis of rotation to secure the plurality of hairs to a plurality of bristles extending from a hair-shaping guide included in the brush head.

Clause 19. The method of any other suitable clause or combination of clauses, wherein the wrapping step further includes the step of holding the hair brush such that tension is placed on the plurality of hairs before heat is applied and at least a portion of the plurality of hairs are in contact with the hair-shaping guide before heat is applied.

Clause 20. The method of any other suitable clause or combination of clauses, wherein the unwrapping step includes removing the plurality of hair from the brush head by rotating the hair brush in a direction around the primary axis opposite that of the engaging direction thereby removing the tension applied to the plurality of hairs after heat has been applied.

Although certain illustrative embodiments have been described in detail above, variations and modifications exist within the scope and spirit of this disclosure as described and as defined in the following claims.

The invention claimed is:

1. A hair brush for use with a person's head of hair, the hair brush comprising a handle including a grip that defines a primary axis and is shaped to be held in a hand of a user, and a brush head coupled to the handle, the brush head including a hair-shaping guide and a plurality of bristles that extend outwardly from the hair-shaping guide in multiple opposing directions when the hair brush is viewed from above along the primary axis, wherein the hair-shaping guide is shaped to form a plurality of bulbs that each define a bulb diameter around the primary axis from which some of the plurality of bristles extend in opposing directions and a plurality of necks that each define a neck diameter around the primary axis from which some of the plurality of bristles extend in opposing directions, the neck diameter being smaller than the bulb diameter, each of the plurality of bulbs shaped to form a partially-hemispherical shape and each of the plurality of necks arranged between a pair of bulbs including the plurality of bulbs along the primary axis to space each bulb in the pair of bulbs from one another, the hair-shaping guide is provided by a hollow shell that forms an interior space and the hollow shell is formed to include a plurality of apertures, and wherein the plurality of bristles extend through the plurality of bristle apertures from the interior space, the hair-shaping guide is configured to engage a plurality of hairs wrapped around the head of the hair brush to shape the plurality of hairs upon application of hot air from a blow dryer so that a desired shape is maintained when the plurality of hairs are unwrapped from the brush head of the hair brush.

2. The hair brush of claim 1, wherein the hollow shell has a substantially constant thickness between the interior space and an outermost surface of the hair-shaping guide.

3. The hair brush of claim 2, wherein the plurality of bristles extend outwardly from the hair-shaping guide along the primary axis at a plurality of angles such that the plurality of bristles extend between a mount portion and the retainer end portion.

4. The hair brush of claim 1, wherein the hair-shaping guide comprises metallic of ceramic-containing materials suitable for heating by hot air from a blow dryer.

5. The hair brush of claim 1, wherein the hair-shaping guide includes a mount portion coupled to the handle along the primary axis, a retainer end portion spaced apart from the mount portion, and a central portion located between the mount portion and the retainer end portion.

6. The hair brush of claim 5, the brush head further including a bristle support rod configured to couple the hair-shaping guide to the handle.

7. The hair brush of claim 5, wherein the handle is further includes a mount adjacent to the grip along the primary axis and the mount portion of the hair-shaping guide configured to receive at least a portion of the mount included in the handle.

8. The hair brush of claim 1, the brush head includes a hair engagement portion arranged inside the hair-shaping guide, made up of the plurality of bristles and a bristle support rod for shaping the plurality of hairs upon application of hot air from the blow dryer so that a desired shape is maintained when the plurality of hairs are unwrapped from the head of the hair brush.

9. A hair brush comprising a handle including a grip that is shaped to be held in a hand of a user, and a brush head coupled to the handle the brush head including a hair-shaping guide and a plurality of bristles that extend outwardly from the hair-shaping guide in opposing directions when the hair brush is viewed from above, wherein the hair-shaping guide is shaped to form a plurality of bulbs each defined by an outermost bulb surface forming a partially-hemispherical shape from which some of the plurality of bristles extend, the plurality of bulbs spaced apart from a central axis of the brush head thereby defining a first distance perpendicular to the central axis and a plurality of necks each defined by an outermost neck surface spaced apart from the central axis thereby defining a second distance perpendicular to the central axis and smaller than the first distance; wherein the outermost bulb surface and the outermost neck surface cooperate to form a hollow shell that forms an interior space and the hollow shell is formed to include a plurality of bristle apertures, and wherein the plurality of bristles extend through the plurality of bristle apertures from the interiors space.

10. The hair brush of claim 9, wherein the plurality of bristles are sized to be larger than the first distance and extend through the bristle apertures, and wherein the plurality of bristles are configured to engage a plurality of hairs.

11. The hair brush of claim 9, wherein the plurality of bristles extend from the hair-shaping guide at a plurality of angles relative to the central axis.

12. The hair brush of claim 11, wherein at least a some of the plurality of bristles extend from the hair-shaping guide at an angle greater than 90° relative to the central axis.

13. The hair brush of claim 12, wherein at least a some of the plurality of bristles extend from the hair-shaping guide at an angle less than 90° relative to the central axis.

* * * * *